US007914163B2

(12) United States Patent
Barrett et al.

(10) Patent No.: US 7,914,163 B2
(45) Date of Patent: Mar. 29, 2011

(54) VENTILATION FAN AND LIGHT

(75) Inventors: James E. Barrett, Germantown, TN (US); Masao Tsuji, Mesa, AZ (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 12/120,554

(22) Filed: May 14, 2008

(65) Prior Publication Data

US 2008/0291679 A1 Nov. 27, 2008

Related U.S. Application Data

(60) Provisional application No. 60/939,174, filed on May 21, 2007.

(51) Int. Cl.
*F21V 33/00* (2006.01)

(52) U.S. Cl. ..... 362/96; 362/294; 362/373

(58) Field of Classification Search ..... 362/96, 362/294

See application file for complete search history.

(56) References Cited

U.S. PATENT DOCUMENTS

| | | | | |
|---|---|---|---|---|
| 2,189,008 | A | 8/1937 | Kurth | 99/33 |
| 2,098,375 | A * | 11/1937 | Child | 165/67 |
| 3,786,233 | A | 1/1974 | Bumpus et al. | 219/343 |
| 3,958,100 | A | 5/1976 | Stone | 219/361 |
| 4,342,073 | A * | 7/1982 | Ranten | 362/294 |
| 5,021,932 | A | 6/1991 | Ivey | 362/96 |
| 5,668,920 | A * | 9/1997 | Pelonis | 392/361 |
| 6,940,051 | B2 | 9/2005 | Tateishi | 219/508 |
| 7,043,146 | B2 | 5/2006 | Semaza | 392/362 |
| 2007/0247832 | A1 * | 10/2007 | Barker | 362/96 |
| 2007/0247854 | A1 * | 10/2007 | Lin | 362/294 |
| 2008/0117636 | A1 * | 5/2008 | Byrne et al. | 362/294 |

* cited by examiner

*Primary Examiner* — Sandra L O Shea
*Assistant Examiner* — Jessica L McMillan
(74) *Attorney, Agent, or Firm* — Baker Donelson

(57) ABSTRACT

A ventilation fan and light (10) is disclosed having a housing (12) and a light kit (13). The housing includes a housing box (15) with a conventional fan scroll (17) having an electric fan (16) mounted therein. The housing also includes a ceiling plate (21) configured to cover the housing box from view. The ceiling plate includes a decorative features (22) and an array of air intake ports (23) extend through the ceiling plate and positioned within a decorative feature to camouflage the air intake port from view. The light kit includes a plurality of light arms (26) which terminate with a light housing (27) and diffusor (28). The spacial relationship between the ceiling plate and the majority of the light kit structure further obscures the air intake ports from view, prevents the build up of heat within the housing, and creates a better airflow pattern within the room in which the light is mounted.

5 Claims, 2 Drawing Sheets

VENTILATION FAN AND LIGHT

REFERENCE TO RELATED APPLICATION

Applicant claims the benefit of U.S. Provisional Patent Application Ser. No. 60/939,174 filed May 21, 2007.

TECHNICAL FIELD

This invention relates to ventilation fans, and specifically to ventilation fans having a light.

BACKGROUND OF THE INVENTION

Ventilation fans having electric motors have existed for many years. Today, some ventilation fans, such as bathroom fans, include a light source. The light source however creates heat which may rise into the ventilation box or housing, which can cause an unsafe temperature situation when the box is concealed in the ceiling or attic of a house.

These ventilation fans also typically include a pattern of air intake slots. These intake slots are aesthetically unpleasing.

Accordingly, it is seen that a need remains for a ventilation fan and light combination that prevents the build up of heat within the unit and which is more pleasing in appearance. It is to the provision of such therefore that the present invention is primarily directed.

SUMMARY OF THE INVENTION

In a preferred form of the invention a ventilation fan mountable to a supporting structure comprises a housing mounted to a supporting structure, an electric fan coupled to the housing, an exhaust outlet in fluid communication with the electric fan, a ceiling plate coupled to the housing, and a light kit having at least one light housing and light diffusor spaced vertically from the ceiling plate. The ceiling plate has a plurality of air intake openings in fluid communication with the electric fan.

DETAILED DESCRIPTION

Figure 1:
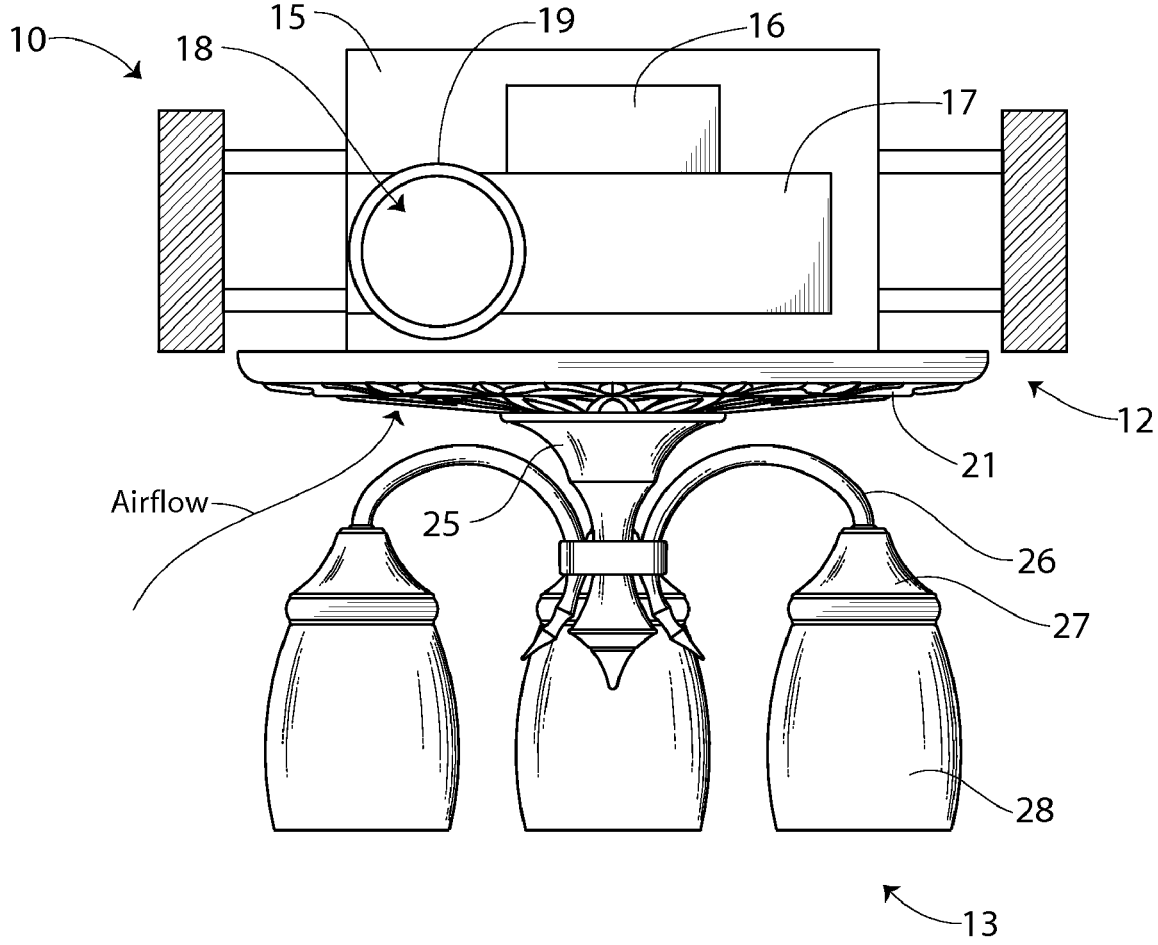
FIG. 1 is a side view of a ventilation fan and light embodying principles of the invention in a preferred form.
Figure 2:
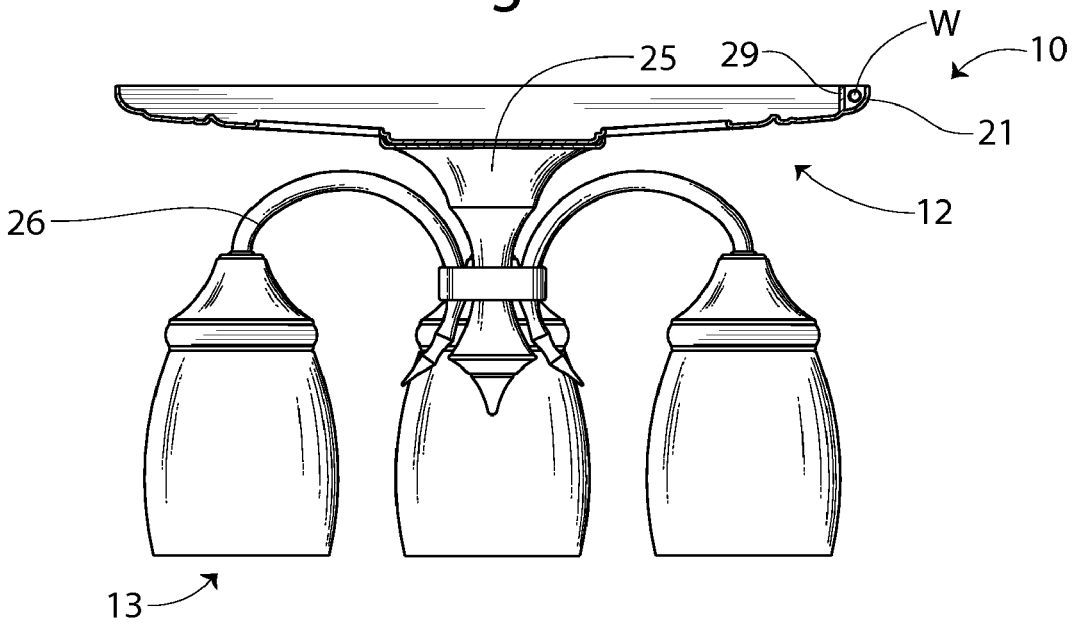
FIG. 2 is a partial cross-sectional side view of the ventilation fan and light of FIG. 1.
Figure 3:
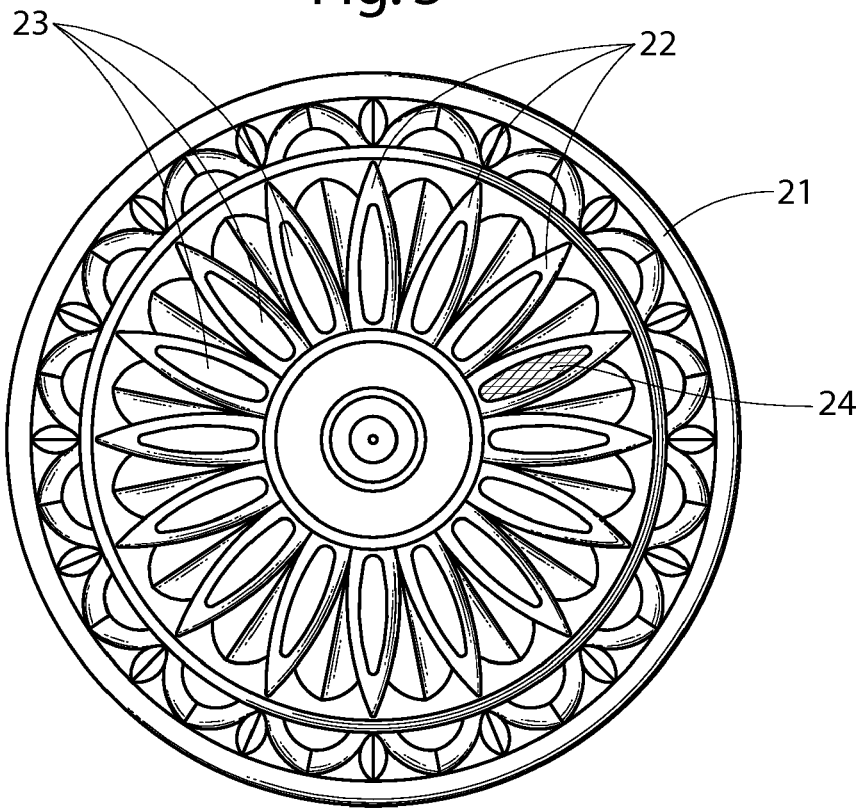
FIG. 3 is a bottom view of a portion of the bath fan and light of FIG. 1.

With reference next to the drawings, there is shown a ventilation fan and light 10 embodying principles of the invention in a preferred form, such as a bathroom fan and light. The ventilation fan and light is hereinafter referred to simply as ventilation fan. The ventilation fan 10 includes an enclosure or housing 12 and a light kit 13 coupled to the bottom side of the housing 12. The housing 12 includes a housing box 15 with a conventional fan scroll 17 having an electric fan 16 mounted therein. The fan scroll 17 forms an exhaust opening 18 in fluid communication with an outlet fitting 19 to direct the flow of exhausted air from the bathroom or similarly enclosed area.

The housing 12 also includes a ceiling plate 21 configured to cover the housing box 15 from view. The ceiling plate 21 includes a raised pattern of decorative features 22 arranged in an annular pattern. An annular array of air intake ports 23 extend through the ceiling plate 21. Each air intake port 23 is positioned or included within a decorative feature 22 to camouflage the air intake port 23 from view, i.e., the air intake ports 23 are arranged within the raised pattern so that they are inconspicuous. The air intake port 23 may be covered with a mesh or screen 24 to obscure the opening. Additionally, the interior of the housing may be finished in a dark color to further obscure the interior from view.

The light kit 13 extends from a central portion of the ceiling plate 21. The light kit 13 includes a central stem 25 from which a plurality of light arms 26 extend. Each light arm 26 terminates with a light housing 27 and diffusor 28. The wiring W associated with the light kit may be enclosed within a channel about the periphery of the top of the ceiling plate to insulate them from heat and to keep them in position. The channel is formed by a channel wall The light housing 27 includes a conventional light bulb socket and light bulb. The spacial relationship between the ceiling plate 21 and the majority of the light kit structure further obscures the air intake ports 23 from view.

In use, the motorized fan 16 draws air into the housing 12 through the air intake ports 23 and transports it out of the housing through the air exhaust port outlet fitting 19. The spacing of the light bulbs distally from the housing 12 allows heat to dissipate into the ambient air, rather than building within the housing box, a problem long associated with bathroom ventilation fans of the prior art. The light diffusors being open on the bottom end also aids in dissipating the heat produced from the light bulbs away from the housing.

Figure 4:
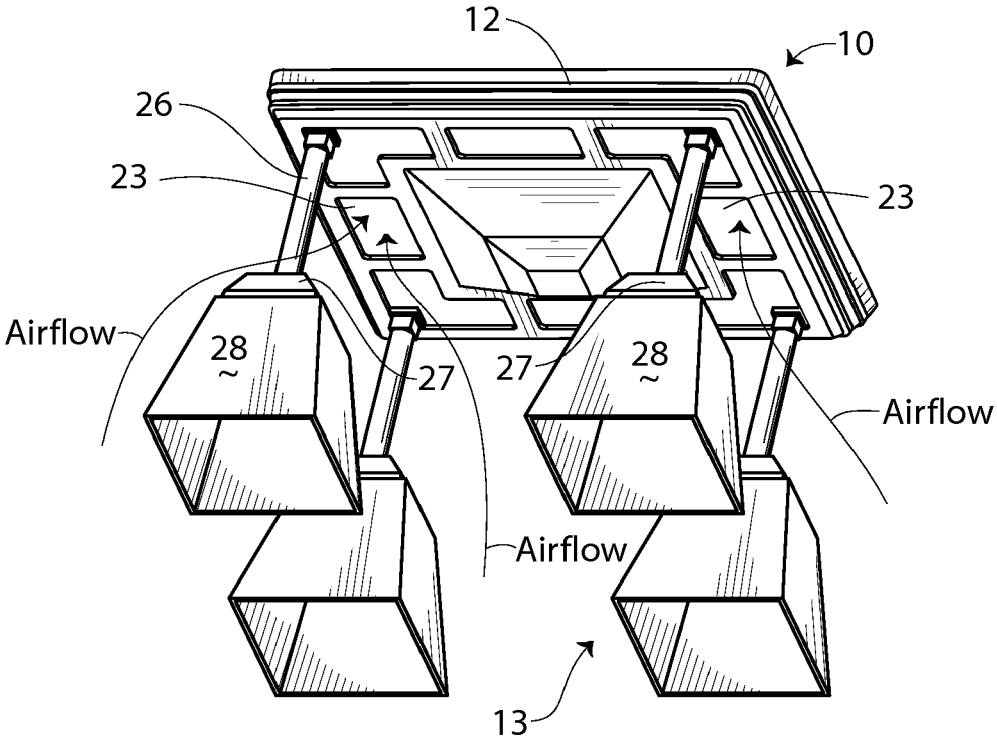
FIG. 4 is a perspective view of a ventilation fan and light embodying principles of the invention in another preferred form.

The spacing of the light housings and diffusors from the ceiling plate 21 causes the airstreams passing into the intake ports to flow about the housings and diffusors. This diversion or spreading of the airstreams over a larger area creates a better ventilation of the room by creating multiple airstreams originating in many different directions or areas of the room, as indicated by the arrows in FIG. 4. This approach is quite different from that of the prior art wherein typical ventilation fan have intakes in one area without such spaced apart lights such that a generally single airstream column is created directly below the ventilation fan.

It should be understood that the light kit may take the form of any conventionally know light and is not limited to the centrally positioned stem type of light kit shown in the preferred embodiment. For example, the light kit may be comprised of multiple but independent hanging lights, such as that shown in FIG. 4. Furthermore, the light kit may include a single light suspended centrally below and spaced from the ceiling plate.

It thus is seen that a ventilation fan and light is now provided which overcomes problems with those of the prior art. While this invention has been described in detail with particular references to the preferred embodiments thereof, it should be understood that many modifications, additions and deletions, in addition to those expressly recited, may be made thereto without departure from the spirit and scope of the invention.

The invention claimed is:

1. A ventilation fan mountable to a supporting structure comprising:

a housing mounted to a supporting structure;

an electric fan coupled to said housing;

an exhaust outlet in fluid communication with said electric fan;

a ceiling plate coupled to said housing adapted to be mounted flushly against a supporting structure ceiling, said ceiling plate having a plurality of air intake openings in fluid communication with said electric fan, and a light kit having at least one light housing and light diffusor spaced vertically from said ceiling plate, and wherein said ceiling plate has a pattern of features, and wherein said plurality of air intake openings are included within said pattern of features.

2. A ventilation fan mountable to a supporting structure comprising:

a housing mounted to a supporting structure;

an electric fan coupled to said housing;

an exhaust outlet in fluid communication with said electric fan;

a ceiling plate coupled to said housing adapted to be mounted flushly against a supporting structure ceiling, said ceiling plate having a plurality of air intake openings in fluid communication with said electric fan, and a light kit having at least one light housing and light diffusor spaced vertically from said ceiling plate, and wherein said light kit comprises a plurality of light housings and light diffusors spaced from said ceiling plate.

3. The ventilation fan of claim 2 wherein said ceiling plate has a pattern of features, and wherein said plurality of air intake openings are included within said pattern of features.

4. A ventilation fan mountable to a supporting structure comprising:

a housing mounted to a supporting structure;

an electric fan coupled to said housing;

an exhaust outlet in fluid communication with said electric fan;

a ceiling plate coupled to said housing adapted to be mounted flushly against a supporting structure ceiling, said ceiling plate having a pattern of decorative features and a plurality of air intake openings associated with decorative features and in fluid communication with said electric fan, and a light kit having at least one light housing and light diffusor spaced from said ceiling plate.

5. The ventilation fan of claim 4 wherein said light kit comprises a plurality of light housings and light diffusors spaced from said ceiling plate.

* * * * *